US010914516B2

(12) United States Patent
Ragot

(10) Patent No.: US 10,914,516 B2
(45) Date of Patent: Feb. 9, 2021

(54) SYSTEM FOR TREATING A GAS DERIVING FROM THE EVAPORATION OF A CRYOGENIC LIQUID AND SUPPLYING PRESSURIZED GAS TO A GAS ENGINE

(71) Applicant: CRYOSTAR SAS, Hesingue (FR)

(72) Inventor: Mathias Ragot, Sierentz (FR)

(73) Assignee: CRYOSTAR SAS, Hesingue (FR)

( * ) Notice: Subject to any disclaimer, the term of this patent is extended or adjusted under 35 U.S.C. 154(b) by 138 days.

(21) Appl. No.: 16/087,135

(22) PCT Filed: Mar. 22, 2017

(86) PCT No.: PCT/FR2017/050669
§ 371 (c)(1),
(2) Date: Sep. 21, 2018

(87) PCT Pub. No.: WO2017/162984
PCT Pub. Date: Sep. 28, 2017

(65) Prior Publication Data

US 2019/0101329 A1 Apr. 4, 2019

(30) Foreign Application Priority Data

Mar. 23, 2016 (FR) ..... 16 52504

(51) Int. Cl.
*F25J 1/00* (2006.01)
*F25J 1/02* (2006.01)

(52) U.S. Cl.
CPC ..... *F25J 1/0025* (2013.01); *F25J 1/004* (2013.01); *F25J 1/0037* (2013.01); *F25J 1/0045* (2013.01);
(Continued)

(58) Field of Classification Search
CPC ..... F25J 1/0025; F25J 1/0294; F25J 1/0296; F25J 1/0288; F25J 1/0277; F25J 1/0244;
(Continued)

(56) References Cited

U.S. PATENT DOCUMENTS 3,224,207 A * 12/1965 Feist ..... F25J 1/0205 62/614
3,919,852 A * 11/1975 Jones ..... F25J 1/0025 62/7

(Continued)

FOREIGN PATENT DOCUMENTS

| | | | |
|---|---|---|---|
| EP | 2746707 A1 | | 6/2014 |
| FR | 3010508 A1 | | 3/2015 |
| FR | 003038964 | * | 7/2015 |

OTHER PUBLICATIONS

International Search Report dated Jun. 16, 2017 issued in corresponding PCT/FR2017/050669 application (2 pages).

*Primary Examiner* — John F Pettitt, III
*Assistant Examiner* — Heather J Huddle
(74) *Attorney, Agent, or Firm* — Millen White Zelano & Branigan, PC; Brion P. Heaney

(57) ABSTRACT

The system for treating a gas deriving from the evaporation of a cryogenic liquid and supplying pressurized gas to a gas engine according to the invention comprises, on the one hand, from upstream to downstream, a reliquefaction unit (10) with compression means (11, 12, 13), a first heat exchanger (17) and expansion means (30), and, on the other hand, a pressurized gas supply line comprising, from upstream to downstream, a pump (48) for pressurizing the liquid and high-pressure vaporization means (61).
The pressurized gas supply line has, upstream of the vaporization means (61), a bypass (57) for supplying a second heat exchanger (60) between, on the one hand, pressurized liquid of the supply line (56) and, on the other hand, a line
(Continued)

(22) of the reliquefaction unit (10) downstream of the first exchanger and upstream of the expansion means (30).

20 Claims, 8 Drawing Sheets

(52) U.S. Cl.
CPC ..... *F25J 1/0202* (2013.01); *F25J 1/023* (2013.01); *F25J 1/0224* (2013.01); *F25J 1/0244* (2013.01); *F25J 1/0277* (2013.01); *F25J 1/0288* (2013.01); *F25J 1/0294* (2013.01); *F25J 1/0296* (2013.01); *F25J 2210/62* (2013.01); *F25J 2220/62* (2013.01); *F25J 2230/08* (2013.01); *F25J 2230/30* (2013.01); *F25J 2235/02* (2013.01); *F25J 2235/60* (2013.01)

(58) Field of Classification Search
CPC .. F25J 1/0224; F25J 1/045; F25J 1/037; F25J 2235/02; F25J 2230/30; F25J 2235/08; F25J 2220/62; F25J 2210/62
See application file for complete search history.

(56) References Cited

U.S. PATENT DOCUMENTS

| | | | | |
|---|---|---|---|---|
| 10,030,815 | B2 * | 7/2018 | Fuchs | F25J 1/023 |
| 2015/0330574 | A1 | 11/2015 | Fuchs et al. | |
| 2016/0216029 | A1 | 7/2016 | Ragot | |
| 2018/0202610 | A1 * | 7/2018 | Vovard | F17C 9/04 |

* cited by examiner

SYSTEM FOR TREATING A GAS DERIVING FROM THE EVAPORATION OF A CRYOGENIC LIQUID AND SUPPLYING PRESSURIZED GAS TO A GAS ENGINE

The present invention relates to a system and a method for treating gas deriving from the evaporation of a cryogenic liquid and for supplying pressurized gas to a gas engine.

The aim of the present invention is more particularly the maritime transportation of cryogenic liquids and even more particularly of liquefied natural gas (LNG). However, the systems and the methods which will be proposed later could also be applicable in onshore installations.

Considering the case of liquefied natural gas, the latter exhibits, at ambient pressure, a temperature of the order of −163° C. (or less). In the maritime transportation of LNG, the latter is placed in tanks on a ship, a methane tanker. Although these tanks are thermally insulated, thermal leaks exist and the external environment adds heat to the liquid contained in the tanks. The liquid is therefore reheated and evaporates. Given the size of the tanks on a methane tanker, based on the thermal insulation conditions and external conditions, several tons of gas can evaporate per hour.

It is not possible to keep the evaporated gas in the tanks of the ship for safety reasons. The pressure in the tanks would increase dangerously. It is therefore essential to let the gas which evaporates escape from the tanks. The regulation prevents discharging this gas (if it is natural gas) into the atmosphere as is. It must be burnt.

To avoid losing this gas which evaporates, it is also known practice, on the one hand, to use it as fuel for the engines onboard the ship transporting it and, on the other hand, to reliquefy it to return it to the tanks from which it comes.

To reliquefy the gas which has evaporated, it is known practice to cool this gas to return it once again to temperature and pressure conditions allowing it to revert to the liquid phase. This cold input is more often than not performed by exchange of heat with a refrigerating circuit comprising, for example, a loop of refrigerant such as nitrogen.

Furthermore, some methane tankers use the natural gas that they transport as fuel to ensure their propulsion. There are several types of engine that operate with natural gas. The present invention relates more particularly to those which are supplied with natural gas in gaseous phase at high pressure. To then supply the engine propelling the methane tanker, gas is pumped from a tank of liquefied natural gas located onboard the methane tanker, then is pressurized using a pump before being vaporized to be able to supply the engine.

The document EP-2 746 707 A1 focuses on a natural gas evaporating from liquefied natural gas storage tanks, typically arranged onboard an ocean-going ship, which is compressed in a compressor with several compression stages. At least a part of the flow of compressed natural gas being sent to a liquefier, which operates typically according to a Brayton cycle, in order to be reliquefied. The temperature of the compressed natural gas coming from the final stage is reduced to a value lower than 0° C. by passage through a heat exchanger. The first compression stage operates here as cold compressor, and the resulting cold compressed natural gas is used in the heat exchanger so as to proceed with the necessary cooling of the flow from the compression stage. Downstream of its passage through the heat exchanger, the cold compressed natural gas circulating through the remaining stages of the compressor. If so desired, a part of the compressed natural gas can serve as fuel to supply the engines of the ocean-going ship. In a variant embodiment (§ [0026]), provision is made to cool the compressed gas in the gaseous state before its liquefaction with, partly, liquid compressed before it is expanded to be used in an engine or a turbine.

The presence of a refrigerating loop with nitrogen in the Brayton cycle, or any other refrigerating gas distinct from the fluid to be refrigerated, involves providing specific equipment items for the refrigerant. Thus, for example, when a refrigerating circuit with nitrogen is provided onboard a ship (or elsewhere), a nitrogen treatment (purification) unit is necessary to allow its use in the cryogenic field. It is also necessary to provide a specific tank, valves and other devices for regulating the circulation of the nitrogen.

When the natural gas supplying the engines of the methane tanker is directly taken from the tanks of the ship, it is preferable to have a high efficiency in the liquefaction because the consumption of gas in gaseous phase is then limited.

The aim of the present invention is then to provide an optimized system that makes it possible to reliquefy gas which has evaporated and supply a gas engine at high pressure. Preferably, the proposed system will make it possible to optimize the quantity of liquid recovered with respect to the share of gas to be reliquefied. Advantageously the proposed system will also be able to be used onboard a ship such as a methane tanker. Preferably, the system will operate without the use of a refrigerant such as nitrogen or the like avoid having two separate circuits with fluids of different natures. The proposed solution will also preferably be no more expensive to produce than the solutions of the prior art.

To this end, the present invention proposes a system for treating a gas deriving from the evaporation of a cryogenic liquid and supplying pressurized gas to a gas engine, said system comprising, on the one hand, from upstream to downstream, a reliquefaction unit with compression means, a first heat exchanger and expansion means, and, on the other hand, a pressurized gas supply line comprising, from upstream to downstream, a pump for pressurizing the liquid and high pressure vaporization means.

According to the present invention, the pressurized gas supply line has, upstream of the vaporization means, a bypass for supplying a second heat exchanger between, on the one hand, pressurized liquid of the supply line and, on the other hand, a line of the reliquefaction unit downstream of the first heat exchanger and upstream of the expansion means.

The proposed solution makes it possible to create a synergy between the reliquefaction of the gas which has evaporated and the production of pressurized gas for supplying an engine, for example an MEGI engine. Indeed, on the one hand there are needs to cool gas and on the other hand there are needs to reheat the liquid before vaporizing it. The proposed second exchanger thus makes it possible to both limit the needs (in cold) of the reliquefaction unit and the needs (in heat) of the high pressure gas supply line. In a novel manner, it is proposed here to "aftercool" the condensed gas. In fact, after the first exchanger, the compressed gas is sufficiently cooled to condense and is mostly in liquid phase under pressure. This pressurized liquid must then be expanded to be able to be reintroduced into the tanks which are substantially at atmospheric pressure (just a little above to avoid the ingress of air). In this expansion, a part of the condensed gas is revaporized. By cooling the condensed gas before expansion, it therefore being in liquid phase, this gas is aftercooled, which makes it possible to limit, in the expansion, the portion of condensed gas which is revaporized.

To further optimize the use of the source of cold originating from the flow of pressurized liquid intended to be vaporized to supply an engine, the bypass can supply, downstream of the second exchanger, a cooling system. It can for example be a third exchanger mounted in series with and downstream of the second exchanger and/or a heat exchanger mounted in parallel with the second exchanger.

In the system described above, it is possible to provide for the bypass to supply, in addition to the second exchanger, one or more exchangers for cooling gas before its reliquefaction.

A particular variant of a system as described above provides for it to also comprise, downstream of the expansion means, a drum separating the gaseous phase from the liquid phase in the expanded fluid; for a line to conduct the gaseous phase to a collecting vessel to mix it with the gas deriving from the evaporation of the cryogenic liquid, and for the bypass to supply a heat exchanger to cool the gaseous phase before its introduction into the collecting vessel.

The system described above is particularly well suited to a reliquefaction unit which uses as refrigerant the same fluid as the fluid to be liquefied. In this advantageous variant, said unit thus comprises, for example, downstream of its compression means, a bypass to a loop comprising second expansion means, and the loop rejoins the circuit upstream of the compression means after having passed through the first heat exchanger in the opposite direction to the fraction of gas in the circuit not diverted by the loop. In this embodiment, provision is preferably made for the compression means to comprise several compression stages each with a compression wheel, for the second expansion means to comprise an expansion turbine and for each compression wheel and the expansion turbine to be associated with one and the same mechanical transmission. Optionally, it is also possible to provide for the system, with such a reliquefaction unit, to further comprise a third heat exchanger between pressurized liquid diverted from the supply line and gas between the compression means and the second expansion means. This third exchanger makes it possible to increase the exchanges and thus therefore to optimize the system. As described above, according to a first variant embodiment, the third exchanger can be mounted in parallel with the second exchanger and, according to another alternative variant embodiment, the third exchanger can be mounted in series with the second exchanger.

The present invention relates also to a ship, in particular a methane tanker, propelled by a gas engine, characterized in that it comprises a system for treating a gas deriving from the evaporation of a cryogenic liquid and supplying pressurized gas to a gas engine as described above.

Finally, the present invention proposes a method for treating a flow of gas deriving from the evaporation of a cryogenic liquid and supplying a gas engine at high pressure, said flow of gas being first of all compressed then cooled and condensed at least partially in a first heat exchanger before being expanded, and the supply of gas at high pressure being provided by pressurizing cryogenic liquid then vaporizing it, characterized in that, after its compression, the pressurized liquid flow is separated into a first part of the liquid flow and a second part of the liquid flow, in that the first part of the liquid flow is used to cool compressed and condensed gas in a second exchanger before expansion of the condensed gas, and in that the second part of the liquid flow receives the first part of the liquid flow after the latter has cooled the compressed gas, all of the liquid flow being then vaporized.

In this method, provision is advantageously made for more than half, and preferably at least 90% by weight, of the compressed gas to be condensed before being cooled in the second exchanger.

To increase the efficiency in the reliquefaction, provision is advantageously made for the pressurized liquid flow to be also used to cool gas before it is condensed.

In a method as described above, provision is advantageously made for a part of the compressed gas to be tapped in the first exchanger to be expanded in an expansion turbine, and for the expanded gas to be introduced into the first exchanger in counter-current to cool the compressed gas and provoke the condensation thereof. In this way, the fluid to be reliquefied is used also as refrigerant and it is not then necessary to provide a refrigerating circuit using another fluid to allow the reliquefaction.

BRIEF DESCRIPTION OF THE DRAWINGS

Details and advantages of the present invention will become more apparent from the following description, given with reference to the attached schematic drawing in which.

Figure 1:
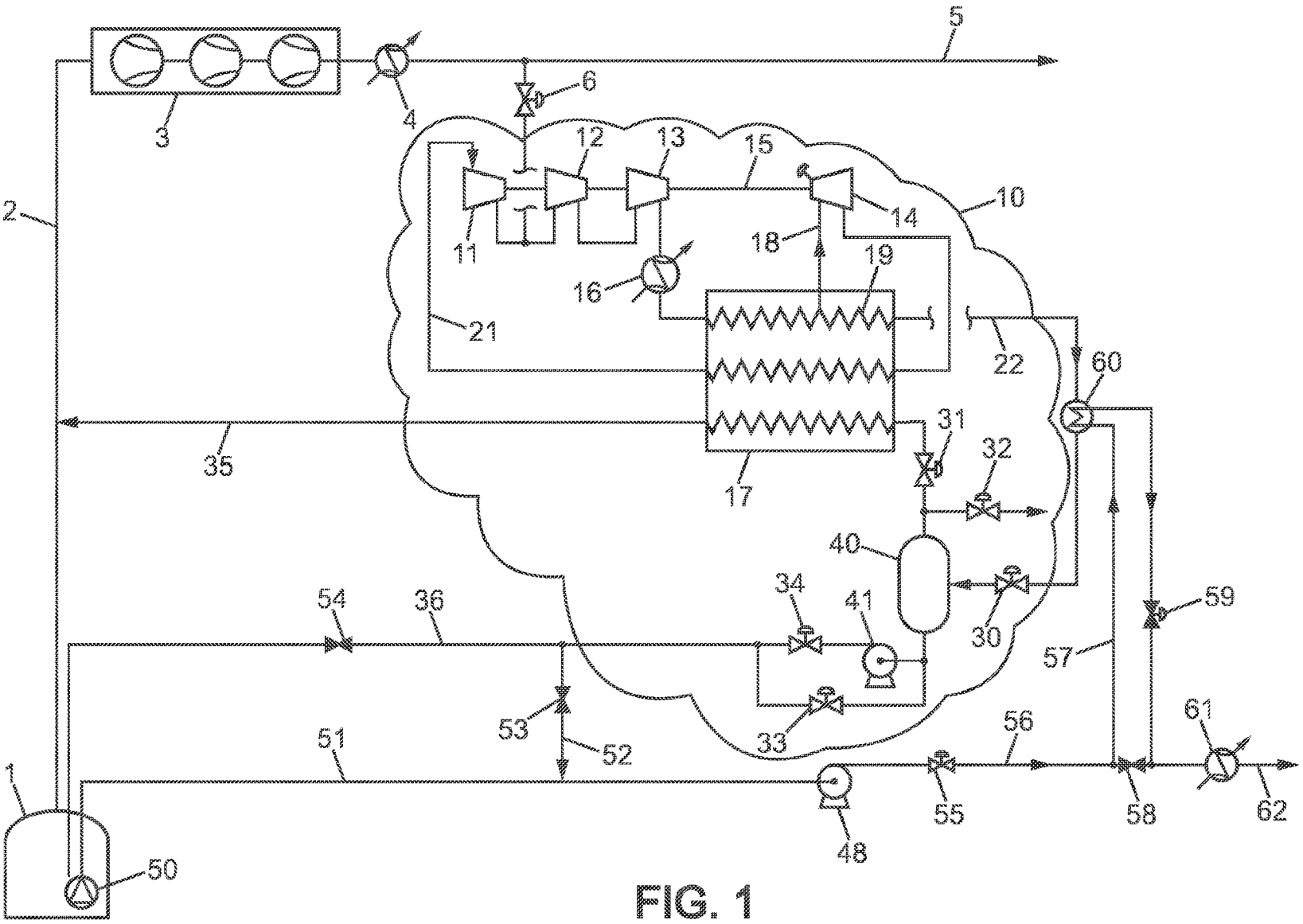
FIGS. 1 to 8 are each a schematic view, according to several variants, of a tank of cryogenic liquid associated with a system for recovering evaporating gas from said tank, with a system for treating a part of the recovered gas to liquefy it and with a high pressure gas supply line to a gas engine.

In each of the attached figures, a tank 1 is illustrated. Throughout the following description, it will be assumed that it is a tank of liquefied natural gas (or LNG) among several other similar tanks onboard an ocean-going ship of methane tanker type.

The numeric values in the following description are given by way of purely illustrative and nonlimiting numerical examples. They are matched to the treatment of LNG onboard a ship but may vary, particularly if the nature of the gas changes.

The tank 1 stores LNG at a temperature of the order of −163° C. which corresponds to the usual storage temperature of LNG at a pressure close to atmospheric pressure. This temperature does of course depend on the composition of the natural gas and on the storage conditions. Since the atmosphere around the tank 1 is at a very much higher temperature than that of the LNG, even though the tank 1 is very well thermally insulated, calories are added to the liquid which heats up and vaporizes. Since the volume of the gas being evaporated is very much greater than that of the corresponding liquid, the pressure in the tank 1 therefore tends to increase over time and as calories are added to the liquid.

To avoid reaching excessively high pressures, the gas which is evaporated is withdrawn as it is evaporated from the tank 1 (and from the other tanks of the ship) and is located in a collecting vessel 2 linked to several tanks. Hereinafter in the description, the gas which is evaporated is called "gas" even when, hereinafter, it is reliquefied. It is thus distinguished from LNG which is taken in liquid form from the tanks to supply an engine.

Provision is made in the systems illustrated in the drawing to use the gas which is evaporated as energy source onboard the ship (for example to produce electricity) and to reliquefy the surplus gas. The aim here is to avoid losing the evaporated gas and therefore either to use it onboard the ship, or to recover it and return it, in liquid phase, into the tank 1. Furthermore, there is provided a line supplying high-pressure gas to a gas engine of MEGI engine type from liquid LNG drawn from the tanks of the ship.

To be used onboard the ship, the gas evaporated from the tanks must first of all be compressed. This compression is then done in a first compression unit 3 which can be, as illustrated in the drawing, multi-staged. This unit, by way of illustrative and nonlimiting numerical example, raises the pressure of the gas collected in the collecting vessel 2 from a pressure substantially equal to atmospheric pressure to a pressure of the order of 15 to 20 bar (1 bar=$10^5$ Pa).

After this first compression stage, the gas passes into an intermediate cooler 4 in which it is cooled without significantly modifying its pressure. The gas which has been heated up in its compression is at a temperature of the order of 40 to 45° C. at the output of the intermediate cooler (these values are given in an illustrative manner and apply in particular for natural gas). The duly compressed and cooled gas can then be sent in gaseous phase by a duct 5 to a generator onboard the ship.

The gas needs at the generator(s) of the ship are often lower than the "production" of gas by evaporation in all the tanks which are onboard the ship. The gas not used in the generator(s) is then sent to a reliquefaction unit 10.

The reliquefaction unit 10 comprises, at its input, a valve 6 intended in particular to control the pressure of the gas in the duct 5, then a main circuit and a loop which will be described hereinbelow.

The main circuit makes it possible, from the gas (in gaseous phase and which is at a pressure of the order of from a few bar to approximately 50 bar—nonlimiting values), to obtain gas in liquid phase that can return into the tank 1.

The method for obtaining this gas in liquid phase to be replaced in the tank is conventional. It involves compressing the gas, cooling it to condense it then expanding it to return it to the pressure prevailing in the tanks. This way of doing things is classic in the field of cryogenics.

There is thus, in the main circuit, first of all a multi-staged compressor here comprising three successive stages with the references 11, 12 and 13. Each stage is formed by a compression wheel and the three compression wheels are driven by one and the same transmission 15 with shafts and pinions. The line between the compression stages in the figures symbolizes the mechanical link between them. In the embodiment illustrated in FIG. 1, the gas arriving in the multi-staged compressor arrives in the second stage 12 of this compressor. Depending on the system, it may perfectly well equally arrive at the first—as illustrated in the other figures of the drawing—or at the third (or more generally nth stage) of this compressor.

After this second compression, the gas passes into an intermediate cooler 16. Its pressure is then a few tens of bar, for example approximately 50 bar, and its temperature is once again of the order of 40 to 45° C.

The duly compressed gas is then cooled and condensed in a first multiflow exchanger 17. The gas circulates in this first exchanger 17 in a first direction. The fluids circulating in the opposite direction (relative to this first direction) and used to cool it will be described later.

At the output of the first exchanger 17, the compressed gas cooled to a temperature of the order of −110 to −120° C. is mostly (almost all) in liquid phase and is sent, still at a pressure of the order of a few tens of bar (for example approximately 50 bar) by an insulated duct 22 to an expansion valve 30.

The expansion through the expansion valve 30 of the condensed gas provides both methane-rich gas in liquid phase and a nitrogen-rich gas in gaseous phase. The separation of this liquid phase and of this gaseous phase is done in a drum 40 in which the pressure is of the order of a few bar, for example between 3 and 5 bar.

The gas in gaseous phase of the drum 40 is preferably returned to the collecting vessel 2. In this way, it can either be used as fuel in a generator, or go back into the reliquefaction unit 10. Since this gas is cold, it can be used to cool and condense the compressed gas in the first exchanger 17. Provision is therefore made to circulate it in the opposite direction in the first exchanger 17 before making it return to the collecting vessel 2.

If the gas in gaseous phase of the drum 40 for various reasons, in particular in transition phases, cannot be recycled to the collecting vessel 2, provision is made to send it to a flare or a combustion unit. A set of valves 31, 32 controls the sending of the gas in gaseous phase from the drum 40 respectively to the collecting vessel 2 by a link duct 35 or to a combustion unit (not represented).

The gas in liquid phase recovered at the bottom of the drum 40 is, for its part, intended to be returned to the tank 1. Depending on the operating conditions, the gas in liquid phase can be sent directly into the tank 1 (passage controlled by a valve 33), or using a pump 41 (passage controlled by a valve 34).

The return of the gas in liquid phase originating from the drum 40, directly or via the pump 41, to the tank 1 is done via an insulated duct 36 here provided with a valve 54, for example a stop valve.

In the reliquefaction unit 10, it is important to ensure the cooling of the gas compressed in the multi-staged compressor (stages 11, 12 and 13). This cooling is usually done using a distinct thermodynamic machine, operating for example according to a Brayton cycle, and using nitrogen as refrigerant. It is possible to use, in the reliquefaction unit 10, such a refrigeration machine which then cools and condenses the gas in the first exchanger 17. However, it is proposed here, as mentioned above, to provide this reliquefaction unit with a cooling loop using the natural gas as refrigerant. This loop begins with a bypassed duct 18 which separates the flow of gas downstream of the multi-staged compressor (stages 11, 12, 13) into a first flow, or main flow, which corresponds to the main circuit described previously, and into a second flow, or diverted flow.

The bypass duct 18 is preferably linked to the main circuit at the first exchanger 17. The gas in gaseous phase which therefore enters into the bypass duct 18 is at "high pressure" (approximately 50 bar in the numeric example given) and at an intermediate temperature between 40° C. and −110° C.

The gas taken via the bypass duct 18 is expanded in expansion means formed by an expansion turbine 14. This expansion turbine 14 is, in the preferred embodiment illustrated in the drawing, linked mechanically to the three compression wheels corresponding to the stages 11, 12 and 13 of the multi-staged compressor of the reliquefaction unit 10. The transmission 15 by shafts and pinions links the expansion turbine 14 and the compression wheels of the multi-staged compressor. This transmission 15 is symbolized by a line linking, in the figures, the expansion turbine 14 to the stages 11, 12 and 13.

The gas is expanded for example to a pressure level which corresponded to its pressure level on entering into the reliquefaction unit 10, i.e. approximately 15 to 20 bar. Its temperature drops below −120° C. This flow of gas (gaseous phase) is then sent into the first exchanger 17 in the opposite direction to cool and condense the pressurized gas of the main circuit, first of all in a portion 19 located downstream of the bypass duct 18 then in a portion of this main circuit in the first exchanger 17 upstream of this bypass duct 18. At the output of the first exchanger 17, the expanded gas returns to temperatures of the order of 40° C. and can be reinjected in gaseous phase into the main circuit of the reliquefaction unit, upstream of the multi-staged compressor by a return duct 21.

Thus, an open cooling loop is produced which uses, as gas for the cooling, the same gas as that which has to be liquefied.

As indicated above, the system illustrated also has a line supplying gas at (high) pressure to a gas engine, for example an engine of MEGI type (not illustrated). This supply line starts from a tank 1. It is first of all fed by a submerged pump 50 which supplies cryogenic liquid (LNG) to a duct 51 to conduct it to a high-pressure pump 48. The high-pressure liquid is then brought by a duct 56 into a vaporizer 61, for example producing a thermal exchange with steam, to produce vapor (natural gas in gaseous phase) at high pressure that can then supply an engine of MEGI type by a supply duct 62.

The presence of a bypass 57 on the duct 56 will be noted in the figures. This bypass 57 will supply pressurized liquid, still in liquid phase, to a second exchanger 60 intended to aftercool condensate leaving the first exchanger 17 in the main circuit of the reliquefaction unit 10. This second exchanger 60, in the embodiment illustrated in FIG. 1, is here provided to produce an exchange of heat between, on one side, the pressurized liquid in the duct 56 supplying the MEGI engine (or the like) and diverted by the bypass 57 and, on the other side, the condensate located in the insulated duct 22 between the first exchanger 17 and the expansion valve 30.

As a purely illustrative and nonlimiting numeric example, the liquid diverted in the bypass 57 is at approximately −150° C. upstream of the second exchanger 60 and reemerges therefrom for example at −140° C. (still in liquid phase). In the insulated duct 22, the condensed gas leaving the first exchanger 17 goes, for its part, for example from −120° C. to −135° C.

In the embodiment of FIG. 1, the regulation of the flows in the duct 56 and the bypass 57 is provided using a valve 55 placed on the duct 56 upstream of the bypass 57 and another valve 59 incorporated in the bypass 57 (illustrated downstream of the second exchanger 60 but the person skilled in the art will understand that this valve 59 could, equivalently, be disposed upstream of the second exchanger 60). A valve 58, with manual or automatic control, is also provided between the two points linking the bypass 57 with the duct 56.

Finally, note in FIG. 1 (and the subsequent figures) the presence of a junction 52 provided with a valve 53 between the insulated duct 36 and the duct 51. This junction 52 makes it possible to directly pass liquid from the reliquefaction unit 10 directly to the duct 51 and therefore to the high-pressure pump 48 without going back through a tank 1. It is thus clearly possible to limit the head losses and the thermal losses.

Figure 2:
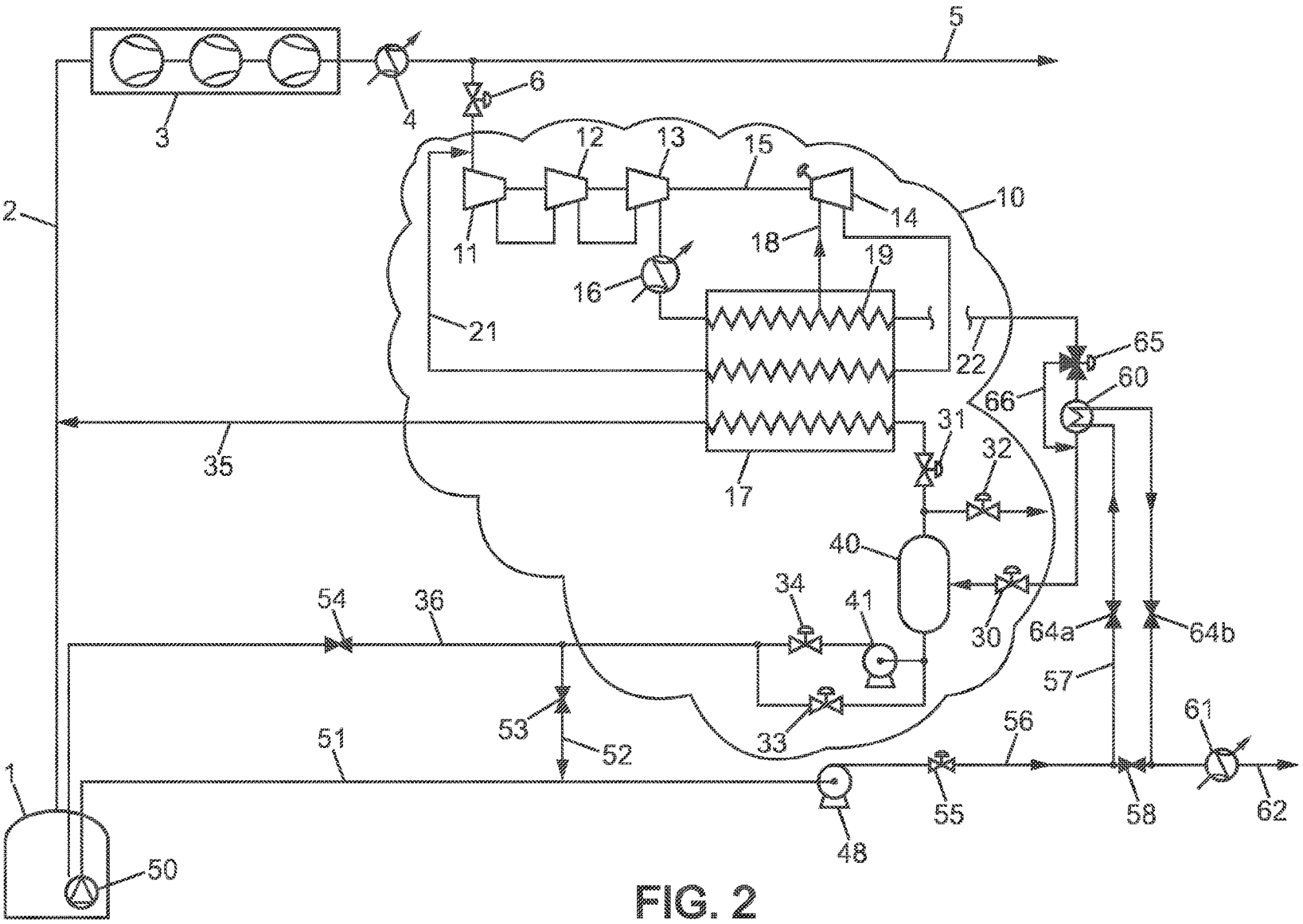

FIG. 2 illustrates a variant embodiment of the system of FIG. 1 with two modifications totally independent of one another. Provision is made here, first of all, as already explained above, to inject the gas compressed in the first compression unit 3 into the first stage 11 of the multi-staged compressor of the reliquefaction unit. Then, provision is made to perform the regulation at the second heat exchanger 60 a little differently. Instead of adjusting the exchanges in the exchanger by varying the flow rates in the bypass 57 (FIG. 1), provision is made here to vary the flow rates passing through the exchanger in the insulated duct 22. Provision is thus made in the embodiment of FIG. 2 for between 0% and 100% of the flow (mixture between gaseous phase and liquid phase but mostly in liquid phase) circulating in the insulated duct 22 to be passed into the second exchanger 60. In order to do this, a bypass duct 66 short-circuits the second exchanger 60. A three-way valve 65 is provided upstream of the second exchanger 60 to regulate the flow of the insulated duct 22 passing through the second exchanger 60 and that passing through the bypass duct 66. Other regulation means could be envisaged (such as, for example, in the bypass 57, with a valve upstream of the bypass duct and a valve in the bypass duct and/or in the branch of circuit containing the second exchanger). In this embodiment, provision is made to be able to also isolate the second exchanger 60 from the MEGI motor supply line (duct 56). To this end, the embodiment of FIG. 2 simply provides for each branch of the bypass 57, a branch upstream and a branch downstream of the second exchanger 60, to be provided with a valve, respectively 64*a* and 64*b*, with manual or controlled control.

Figure 3:
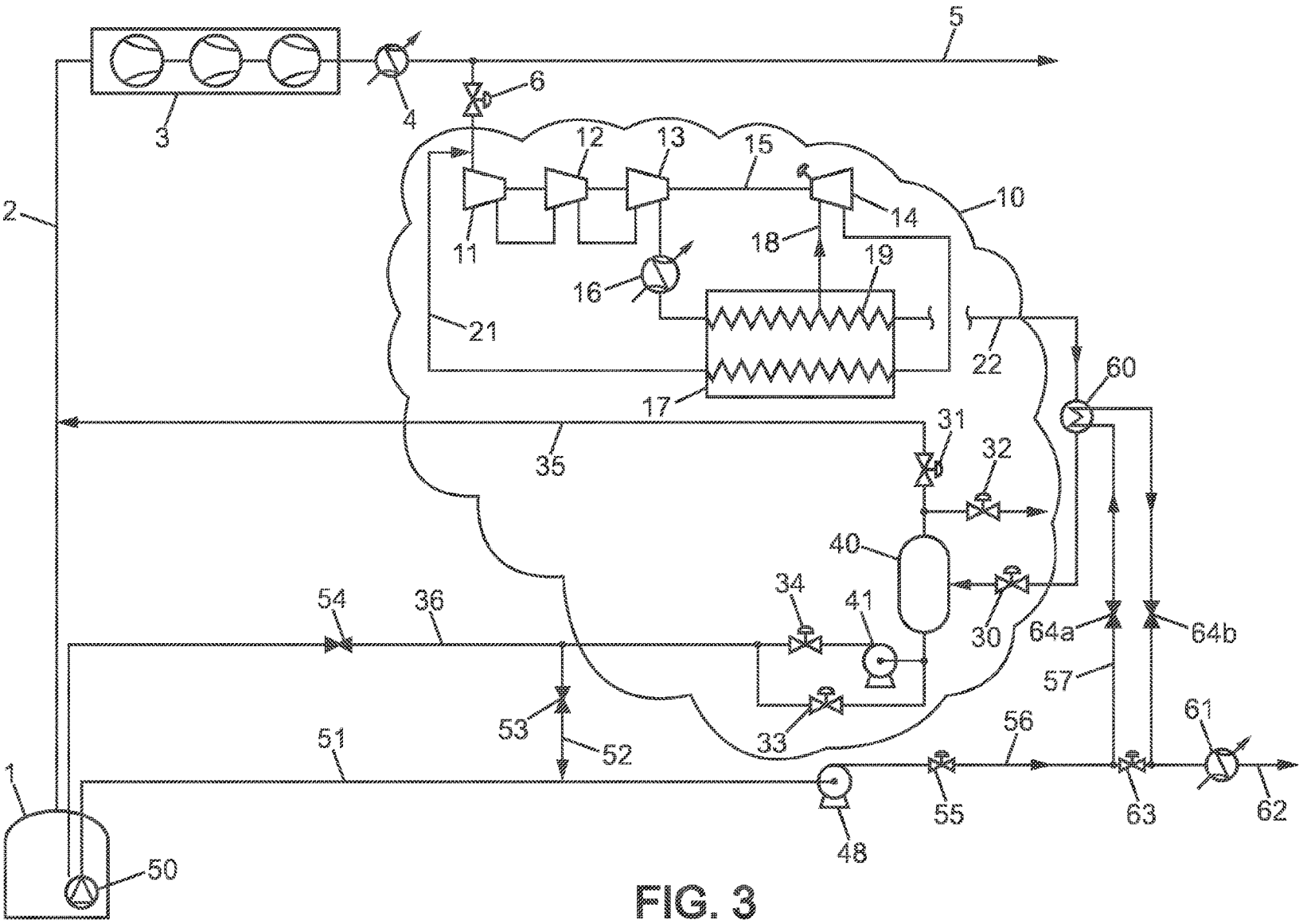

In the variant embodiment of FIG. 3, provision is made to simplify the structure of the first exchanger 17 (this simplification could also be proposed in the other variant embodiments of the invention). Here the link duct 35 between the drum 40 and the collecting vessel 2 no longer passes through the first exchanger 17 whose structure is thus simplified. By virtue of the exchanges produced in the second exchanger 60, it is possible to obtain a good reliquefaction of the evaporated gases in the reliquefaction unit 10 with a first exchanger 17 of simpler structure and therefore lower cost price.

In the embodiment of this FIG. 3, another regulation of the flows in the bypass 57 is proposed. In this variant, a valve 63 is disposed between the two points linking the bypass 57 with the duct 56 of the engine supply line (not represented).

Figure 4:
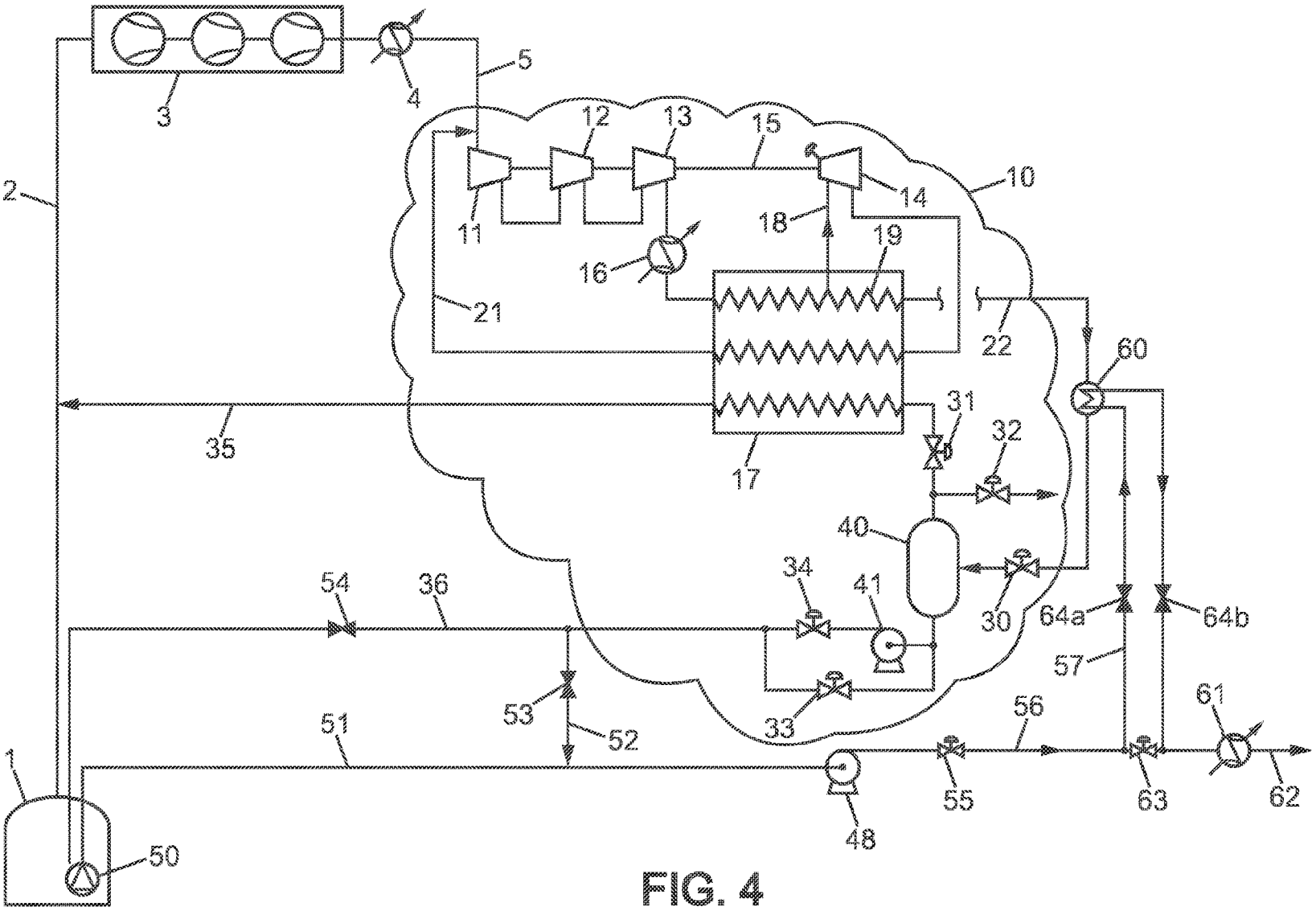

In FIG. 4, provision is made to pass all the evaporated gas recovered from the tanks 1 by the collecting vessel 2 first of all into the first compression unit 3 then into the reliquefaction unit 10.

Figure 5:
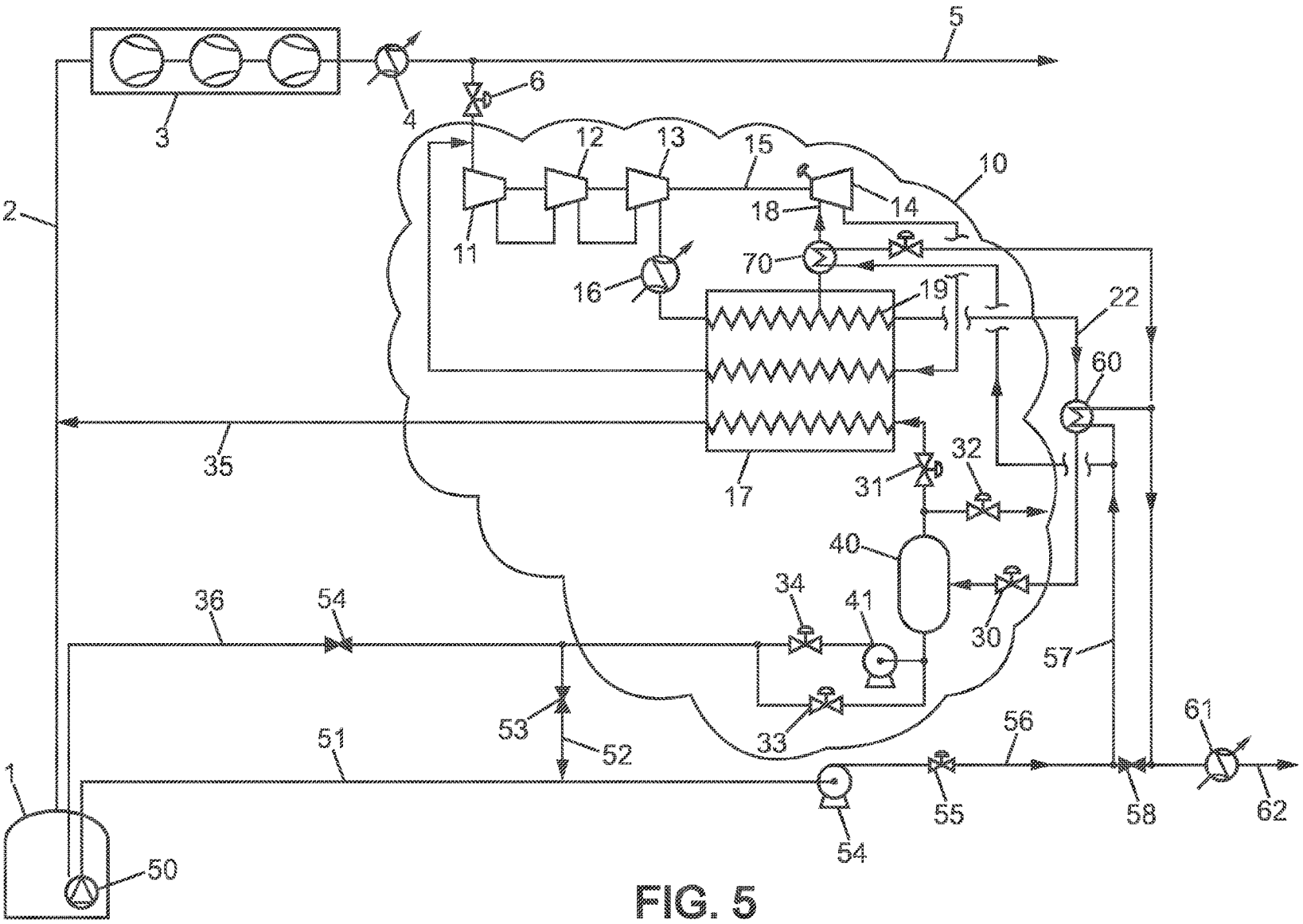
Figure 6:
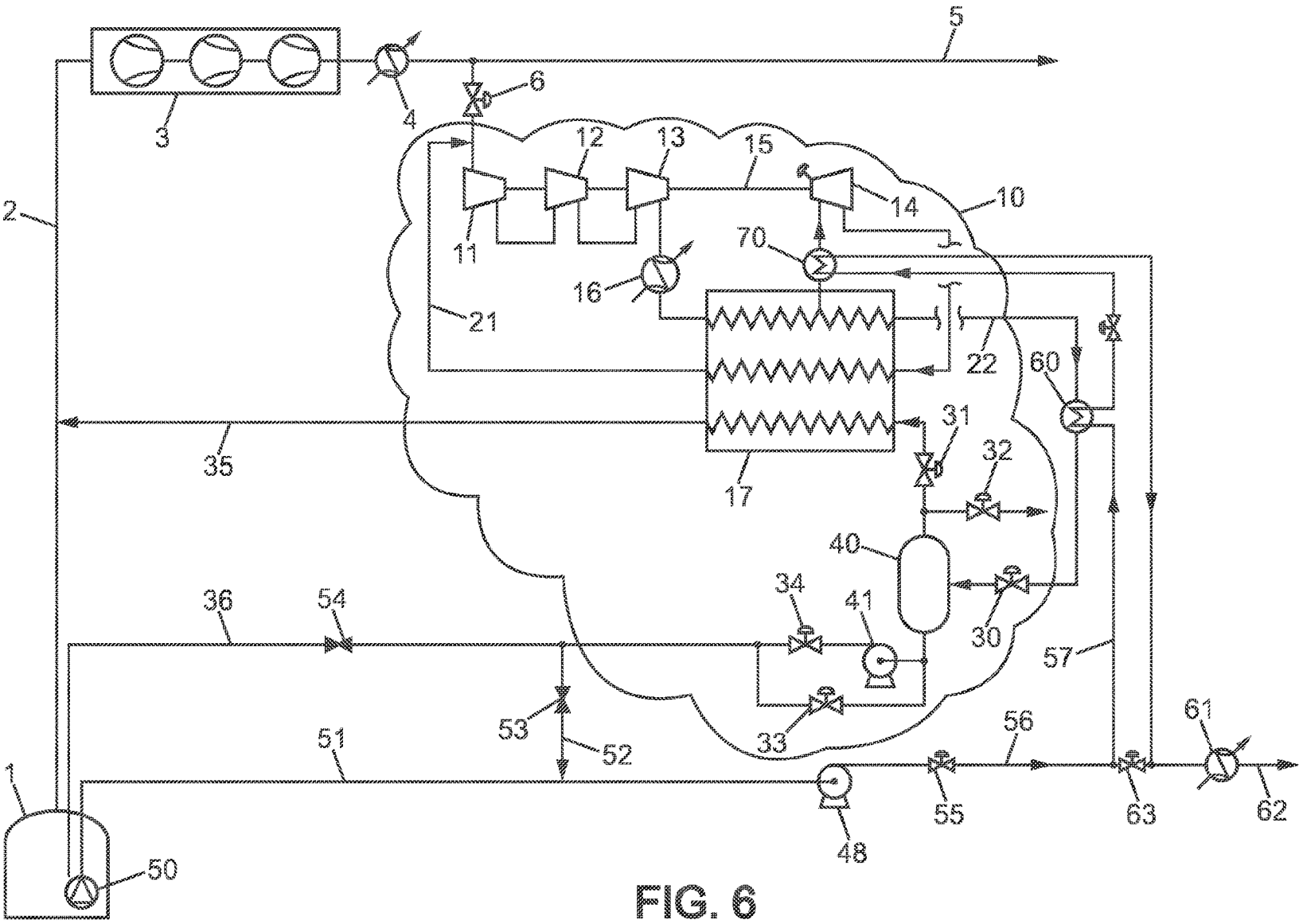

FIGS. 5 and 6 illustrate embodiments implementing a third heat exchanger 70 for cooling the gas in gaseous phase entering into the open refrigeration loop of the reliquefaction unit 10. The exchange is done here between the liquid of the line 56 and the compressed gas in gaseous phase and already partially cooled in the bypassed duct 18.

In the embodiment of FIG. 5, the third exchanger 70 is mounted in parallel with the second exchanger 60 whereas, in the embodiment of FIG. 6, the third exchanger 70 is mounted in series with (and downstream of) the second exchanger 60.

Figure 7:
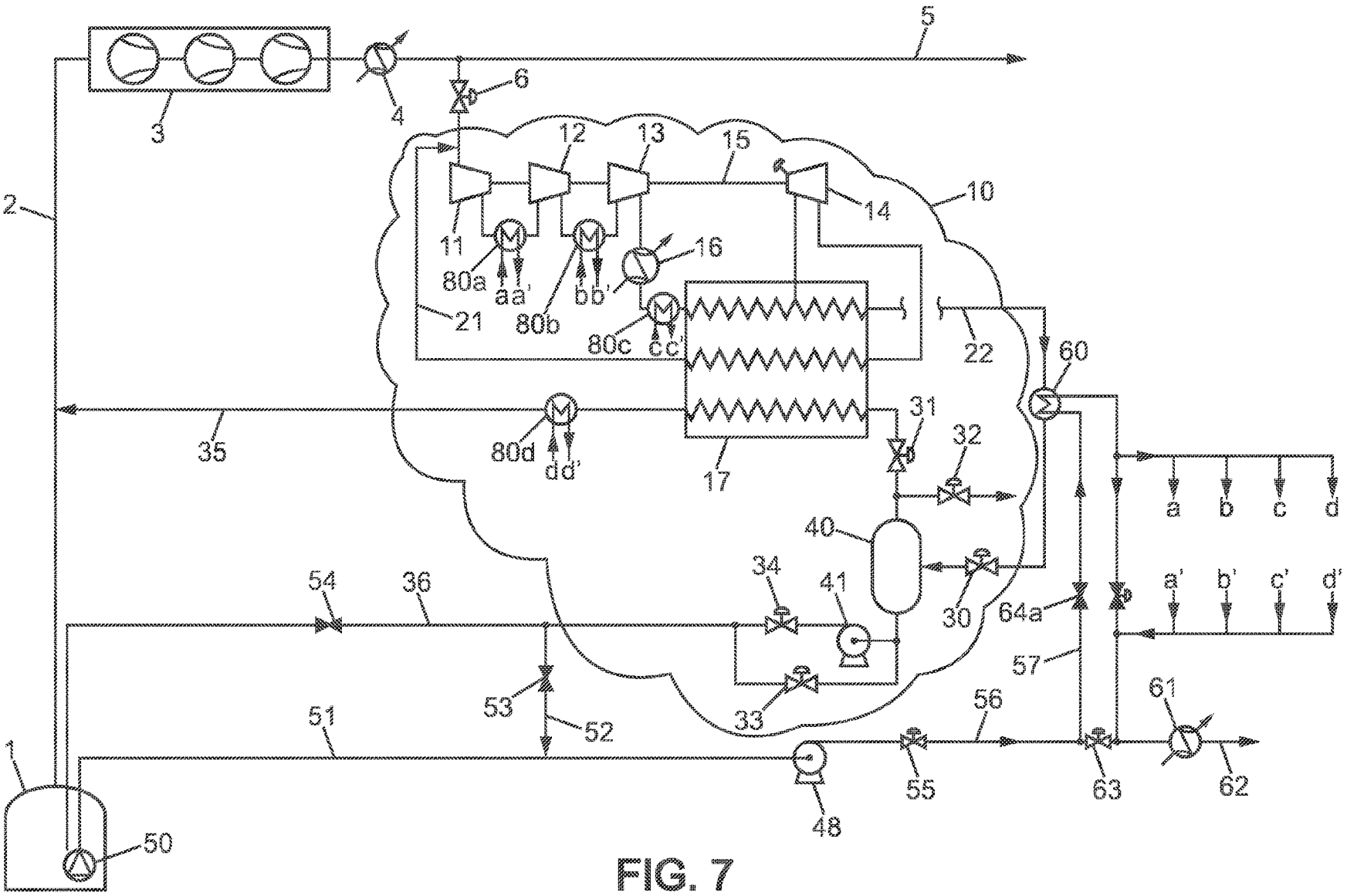

FIG. 7 proposes an embodiment in which four heat exchangers 80*a-d* are provided at various points of the main circuit of the reliquefaction unit 10 to cool the gas still in gaseous phase before liquefying it. The exchanger 80*a* is intended here to cool the gas compressed in the first stage 11 of the multi-staged compressor before it enters into the second stage 12 of this compressor. The exchanger 80*b* is disposed similarly between the second stage 12 and the third stage 13. Another exchanger 80*c* is disposed downstream of the multi-staged compressor, before or after the intermediate cooler 16 and before the first exchanger 17. Finally, it is proposed here to also dispose a heat exchanger 80*d* on the link duct 35 to cool the gas returning to the collecting vessel 2.

This embodiment is supposed to be illustrative (and nonlimiting) of the various possibilities or positioning of exchangers supplied with cryogenic liquid at high pressure. There can be four, or even more, or even less, exchangers. They are preferably mounted in parallel as illustrated, the exchangers 80*n* forming an exchange system mounted in series with the second exchanger 60. Other assemblies (series or parallel) can be envisaged. It is also possible to provide exchangers on the open loop cooling circuit.

Figure 8:
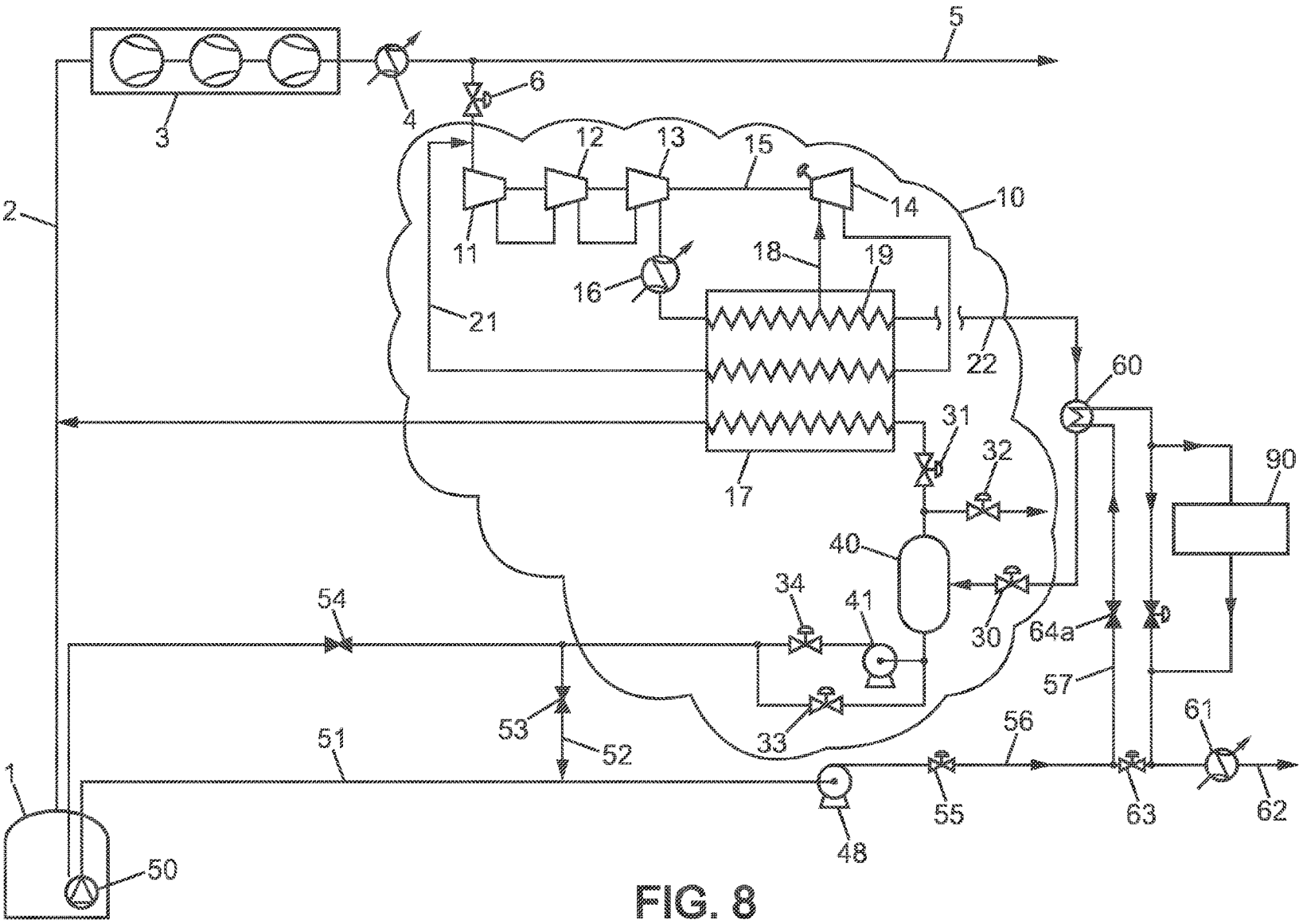

Finally, FIG. 8 is attached to illustrate that the pressurized liquid (still in liquid phase) in the duct 56 can also be used, partially, to cool other elements in a cooling system 90 onboard the ship. The liquid used for the cooling system 90 is preferably disposed downstream of the second exchanger 60 such that the liquid from the duct 56 taken into the bypass 57 is used mostly for cooling at the reliquefaction unit 10. The cooling system can for example be an air-conditioning or, industrial cold, or other such unit.

The variants proposed in the various embodiments can be combined in various ways to produce other embodiments according to the present invention but not illustrated.

The system proposed here provides cooperation between a liquefaction unit and a high-pressure gas supply, for example for supplying an engine of MEGI type. A synergy is created between these two subsystems, one having cold needs to liquefy a gas and the other requiring energy to vaporize liquid at high pressure. The system as proposed makes it possible to increase the efficiency of the reliquefaction unit, that is to say increase the proportion of evaporated gas which is reliquefied, to limit the needs in terms of cold to be supplied to produce the reliquefaction of the evaporated gas and at the same time to limit the energy needs to obtain a gas at high pressure to supply an engine (MEGI engine or other system operating with gas at high pressure).

The system proposed here is particularly well suited to a reliquefaction unit having an open loop of refrigerating gas corresponding to the gas refrigerated with a production of cold at two different temperatures, a temperature of approximately −120° C. at the output of the expansion turbine and a temperature of approximately −160° C. at the output of the expansion valve.

The system is independent of the engines located onboard the ship and which are supplied with the evaporated gas. It is possible to have two different types of engines with different gases, one being supplied by a high-pressure supply line and the other being supplied by the evaporated gas compressed by the first compression unit. The system also makes it possible, from the evaporated gas, independently of any other external cold source, to produce a liquefaction.

In the bypass created on the high pressure gas supply line, the cold production can be adapted to the load of the reliquefaction unit and can be regulated over a wide range.

The proposed system does not require any nitrogen treatment unit or the like. Its structure is simplified by the use of a refrigerating gas of the same kind as the gas to be refrigerated and to be liquefied and which also serves as fuel for an engine (or the like).

Obviously, the present invention is not limited to the embodiments of the systems and methods described above by way of nonlimiting examples, but it relates also to all the variant embodiments within the reach of the person skilled in the art within the scope of the claims hereinbelow.

The invention claimed is:

1. An apparatus for treating a gas obtained from the evaporation of a cryogenic liquid in a storage tank and for supplying pressurized gas obtained from the cryogenic liquid in said storage tank to a gas engine, said apparatus comprising:

a reliquefaction unit for reliquefying at least a part of the gas obtained from the evaporation of the cryogenic liquid, said reliquefaction unit comprising, from upstream to downstream, compression means, a first heat exchanger and expansion means, and wherein the gas obtained from the evaporation of the cryogenic liquid is first compressed in said compression means, then cooled and at least partially condensed in said first heat exchanger before being expanded in said expansion means, a pressurized gas supply line comprising, from upstream to downstream, a pump for pressurizing the cryogenic liquid and a high-pressure vaporization means, wherein the pressurized gas supply line further comprises, upstream of the high-pressure vaporization means, a bypass for supplying a second heat exchanger that provides heat exchange between pressurized cryogenic liquid of the pressurized gas supply line and a line of the reliquefaction unit downstream of the first heat exchanger and upstream of the expansion means.

2. The apparatus as claimed in claim 1, wherein the bypass supplies, downstream of the second exchanger, a cooling system.

3. The apparatus as claimed in claim 1, further comprising a third exchanger mounted in series with and downstream of the second exchanger.

4. The apparatus as claimed in claim 1, further comprising a heat exchanger mounted in parallel with the second exchanger.

5. The apparatus as claimed in claim 1, wherein the bypass further comprises, in addition to the second exchanger, one or more exchangers for cooling the gas obtained from the evaporation of the cryogenic liquid before the gas obtained from the evaporation of the cryogenic liquid is cooled and at least partially condensed in said first heat exchanger.

6. The apparatus as claimed in claim 1, further comprising, downstream of the expansion means, a drum for separating expanded fluid obtained from said expansion means into a gaseous phase and a liquid phase, wherein a line conducts the gaseous phase away from the drum and combines the gaseous phase with the gas obtained by the evaporation of the cryogenic liquid, and wherein the bypass comprises a further a heat exchanger for cooling the gaseous phase by heat exchange with the pressurized cryogenic liquid before the gaseous phase is combined with the gas obtained by the evaporation of the cryogenic liquid.

7. The apparatus as claimed in claim 1, wherein the reliquefaction unit further comprises, downstream of the compression means, a bypass for diverting a portion of the gas obtained from the evaporation of the cryogenic liquid while the remainder of the gas obtained from the evaporation of the cryogenic liquid passes through the first heat exchanger, said bypass comprising second expansion means, wherein downstream of said second expansion means the bypass passes through the first heat exchanger to cool the remainder of the gas obtained from the evaporation of the cryogenic liquid and then the bypass combines the diverted portion with the gas obtained from the evaporation of the cryogenic liquid at a point upstream of the compression means.

8. The apparatus as claimed in claim 7, wherein the compression means comprise several compression stages each with a compression wheel, and the second expansion means comprise an expansion turbine, and wherein each compression wheel and the expansion turbine are associated with one and the same mechanical transmission (15).

9. The apparatus as claimed in claim 7, wherein said bypass further comprises a third heat exchanger that provides heat exchange between the pressurized cryogenic liquid and the portion of the gas obtained from the evaporation of the cryogenic liquid at a point upstream of the second expansion means.

10. A ship wherein said ship comprises an apparatus as claimed in claim 1.

11. A method for treating a flow of gas obtained from evaporation of a cryogenic liquid in a storage tank and for supplying a pressurized flow of gas to a gas engine, said method comprising:

compressing said flow of gas and then cooling and at least partially condensing the compressed flow of gas in a first heat exchanger before expanding the compressed and at least partially condensed flow of gas, and pressurizing cryogenic liquid from said storage tank and then vaporizing the pressurized cryogenic liquid to provide said pressurized flow of gas, wherein the pressurized cryogenic liquid is separated into a first part and a second part, wherein the first part is used to cool the compressed and at least partially condensed flow of gas in a second exchanger before expansion of the compressed and at least partially condensed flow of gas, and wherein the second part is combined with the first part after the first part has cooled the compressed and at least partially condensed flow of gas, and the combined first part and second part of the pressurized cryogenic liquid is then vaporized to provide said pressurized flow of gas.

12. The method as claimed in claim 11, wherein more than half, by weight, of the compressed and at least partially condensed flow of gas is condensed before being cooled in the second exchanger.

13. The method as claimed in claim 11, wherein the pressurized cryogenic liquid is also used to cool the compressed flow of gas upstream of the first heat exchanger.

14. The method as claimed in claim 11, wherein a part of the compressed flow of gas is branched off in the first exchanger and expanded in an expansion turbine, and the resultant expanded flow of gas is introduced into the first exchanger in counter-current flow to the compressed gas to cool and at least partially condense the compressed flow of gas.

15. The method as claimed in claim 11, wherein at least 90% by weight, of the compressed and at least partially condensed flow of gas is condensed before being cooled in the second exchanger.

16. The apparatus as claimed in claim 1, further comprising, upstream of said reliquefaction unit, an initial compression means which is a multi-stage compressor for initial compression of the gas obtained from the evaporation of the cryogenic liquid.

17. The apparatus as claimed in claim 6, further comprising, upstream of said reliquefaction unit, an initial compression means which is a multi-stage compressor for initial compression of the gas stream formed by combining the gaseous phase from the drum with the gas obtained by the evaporation of the cryogenic liquid.

18. The apparatus as claimed in claim 1, further comprising, downstream of the expansion means, a drum for separating expanded fluid obtained from said expansion means into a gaseous phase and a liquid phase, and a line for conducting the liquid phase away from said drum to said storage tank.

19. The apparatus as claimed in claim 6, further comprising a line for conducting the liquid phase away from said drum to said storage tank.

20. The apparatus as claimed in claim 19, wherein the reliquefaction unit further comprises, downstream of the compression means, a bypass for diverting a portion of the gas obtained from the evaporation of the cryogenic liquid downstream of the compression means while the remainder of the gas obtained from the evaporation of the cryogenic liquid passes through the first heat exchanger, said bypass comprising second expansion means, wherein downstream of said second expansion means the bypass passes through the first heat exchanger to cool the remainder of the gas obtained from the evaporation of the cryogenic liquid and then the bypass combines the diverted portion with the gas obtained from the evaporation of the cryogenic liquid at a point upstream of the compression means.

* * * * *